United States Patent [19]

Green

[11] 4,193,494

[45] Mar. 18, 1980

[54] CUP AND PACKAGE OF CUPS

[75] Inventor: John F. Green, Wood Dale, Ill.

[73] Assignee: Compact Industries, Inc., Schaumburg, Ill.

[21] Appl. No.: 937,077

[22] Filed: Aug. 28, 1978

[51] Int. Cl.[2] ..... B65D 62/00; B65D 85/72; B65D 21/02

[52] U.S. Cl. ..... 206/217; 206/519; 229/1.5 B

[58] Field of Search ..... 229/1.5 B; 206/217, 206/520

[56] References Cited

U.S. PATENT DOCUMENTS

| | | | |
|---|---|---|---|
| 2,971,304 | 2/1961 | 0'Neil | 206/217 |
| 3,227,273 | 1/1966 | Syverson | 206/217 |
| 3,495,733 | 2/1970 | Davis | 229/1.5 B |
| 3,696,987 | 10/1972 | Schuff | 229/1.5 B |
| 4,024,951 | 5/1977 | Green | 206/217 |

*Primary Examiner*—George E. Lowrance
*Attorney, Agent, or Firm*—Fitch, Even & Tabin

[57] ABSTRACT

Food storage vessels in the form of foam polystyrene cups are each formed with an enlarged cap seat extending from a bottom wall of the cup to define a compartment to be filled when the cups are inverted, with deliquescent or hygroscopic material which can be reconstituted with the addition of water. The cups are inverted after stacking and held together by means applying endwise pressure thereto. In this nested and stacked condition, each cup has a depending base wall, which forms the cap seat, in sealed engagement with an adjacent portion of an adjacent nested cup to provide a sealed enclosure for the material between adjacent cups. Each of the cups is a thick wall, one-piece molded plastic cup preferably of foamed polystyrene.

6 Claims, 3 Drawing Figures

CUP AND PACKAGE OF CUPS

The present invention relates generally to the packaging of dehydrated, deliquescent or hygroscopic materials between adjacent food storage vessels in a stack. More specifically, it relates to food storage vessels in the form of plastic cups and to a stack of cups which contain preselected amounts of material or food products such as coffee, cocoa, oatmeal, soup or the like, in each cup.

The present invention is directed to an improvement in food storage vessels and the manner of packaging food therein as heretofore disclosed in U.S. Pat. No. 3,227,273. The cups illustrated therein are paper cups which are formed with a cap seat into which is deposited the food or beverage material. (Hereinafter, dehydrated material or dehydrated product shall be understood to mean any dehydrated, deliquescent or hygroscopic material which can be reconstituted, dehydrated or otherwise prepared by the addition of water or similar liquid.) The cups are nested to define sealed enclosures and axially directed pressure holds the cups sealed. The widest use of such cups is for hot coffee. Coffee requires a limited volume and the present cap seat on most paper cups is sufficient for coffee but they may be insufficient for more bulky food or beverage materials such as breakfast foods, hot chocolate, etc. The paper cups typically employed are standard or conventional cups made on conventional machines for forming paper cups used to hold liquid only. The cap seat in such cups is usually quite small in depth, for example, about 0.01 to 0.02 inch in depth. There is an increasing trend to use such packaging for instant breakfast foods such as oatmeal or grits in which such a limited depth of cap seat is insufficient.

Furthermore, the heat retention capability of these conventional paper cups is less than desired for mixing and maintaining some food products when contrasted with foam polystyrene cups. Recent increases in the cost of wood and paper products has depleted or destroyed the cost advantage that paper cups enjoyed over plastic cups. Also, for certain hot foods, the paper tends to impart a "paper taste" whereas foam polystyrene cups do not impart such a "paper taste" to a reconstituted food product.

Although it has been suggested that these nested cups may be constructed of plastic material, thin walled, one-piece plastic thermoformed cups either lack a cap seat or have a cap seat that is too small to hold a sufficient amount of food product. Large cap seats are a waste of plastic as the cap seat does not hold liquid or a food product in conventional plastic cups; and even more importantly, the increased stacking height of cups with large cap seats adds considerably to the height of a stack of nested cups making them more costly to ship and store. Thin walled thermoformed cups also are not satisfactory for hot chocolate or coffee since they cannot be used without a holder since they become too hot for a person to hold. Furthermore, rapid heat transfer can occur due to the thin wall construction which may interfere with the rehydration of the food product making the food less palatable.

It has also been suggested in U.S. Pat. No. 4,024,951, that food storage vessels may be constructed of molded, expanded polystyrene and nested with a food product stored in a sealed enclosure between adjacent cups. These cups, however, utilize a different cup nesting technique and have a small undersurface are a enclosure to prevent dusting by residual food products of any surface on which the cup might rest. These cups are filled from the top and employ an internal shoulder to create the food product enclosure.

Accordingly, it is a general object of the present invention to provide an improved food storage vessel and a package of such nested vessels obviating, for practical purposes, the above-mentioned limitations heretofore present.

Other objects and advantages of the invention are more particularly set forth in the following detailed description, and in the accompanying drawing, of which:

Figure 3:
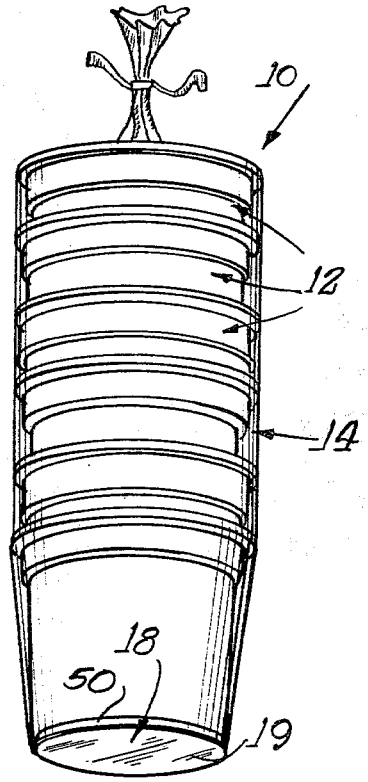

With reference to FIG. 3, there is generally shown a package 10 of nested cups 12 which define sealed enclosures between adjacent cups containing dehydrated material such as a food product. The cups 12 are maintained in the nested or stacked position and sealed condition with one another by means which applies an axially or endwise compressive force to the cup. One means used to apply this endwise pressure is an encomassing bag or cover 14 which is shrunk, either by heat or a vaccum, tightly about the stack of cups 12 to provide the axially compressive force thereto. However, other means for applying an axial or endwise pressure to maintain the stack such as an encircling restraining band may be provided.

As explained above, the use of paper cups with small cap seats and with the limitations of paper from the standpoints of heat transfer and a taste imparting material are now being used. While conventional plastic cups are available, they lack the desired means for providing sealed enclosures in which to store food materials and/or sufficient area in their cap seats to be filled as in the manner of bottom-filled paper cups.

In accordance with the present invention, food storage vessels in the form of foamed polystyrene cups 12 are formed with a circumferentially extending base wall 22 depending downwardly from a bottom wall 18 by at least 0.30 inch and preferably to about 0.50 inch to define a large cap seat; and these cups are nested in a stacked condition with a food product disposed in a sealed enclosure 25 formed by the seat of one cup and an adjacent portion of a next adjacent cup. The enlarged plastic cap seat allows the cups 12 to be bottom filled with the food product being dispensed onto a surface 19 of the bottom wall, the surface 19 facing upwardly when the cup is inverted during filling and facing downwardly when the cup is turned to its usual position in which the bottom wall 18 is at the lower end of the cup, as shown in FIG. 3. Herein, the sealed enclosure 25 is preferably formed by tight intimate contact between the annular flat rim surface 36 at the bottom of the base wall 22 and an internal, radially extending shoulder wall 28 within the interior of an adjacent cup. When a means such as the shrunk cover 14 applies an endwise pressure to the stack of nested cups, the sealed enclosure is thus formed between adjacent cups to keep the food product generally sealed and protected from the inflow of moisture vapor or other airborne foreign matter. As will be explained hereinafter, other surfaces on adjacent nested cups may be contacted to form a sealed enclosure 14 and other means may be used to exert endwise pressure to hold these surfaces in intimate contact with one another.

Figure 1:
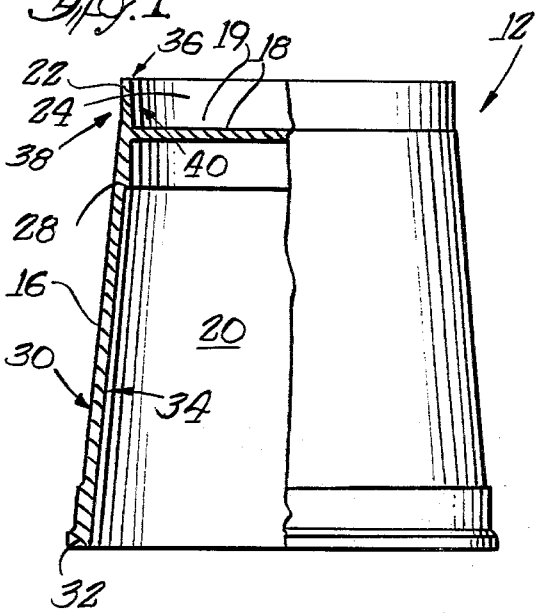
FIG. 1 is a side view of an inverted cup embodying certain features of the present invention with a portion broken away and shown in section.

Turning now to FIG. 1, a cup 12, employing certain features of the present invention, is shown inverted since the dehydrated material is added to the cup when inverted. The cup 12 has a thick wall construction of molded foamed polystrene plastic. The cup 12 has a side wall 16 shaped generally like the frustum of a cone and a generally horizontal bottom wall 18 joined to the side wall 16. The bottom wall 18 and the side wall 16 together define a liquid holding and/or mixing chamber 20 in which the dehydrated material may be mixed with water or other liquid. Of course, when the food is mixed, the cup 12 is not inverted as shown in FIG. 1. Herein, the base wall 22 is generally cylindrically shaped and joined to the bottom wall 18. The base wall 22 extends approximately 0.30 to 0.5 inches from the bottom wall 18 to define, together with the bottom wall 18, an enlarged cap seat or food receiving receptacle 24 when the cup is inverted. The base wall 22 is shown extending upwardly from the bottom wall 18 in FIG. 1, so that enclosure 24 also opens upwardly to receive a food product being dispensed downwardly into the enlarged cup seat 24.

Figure 2:
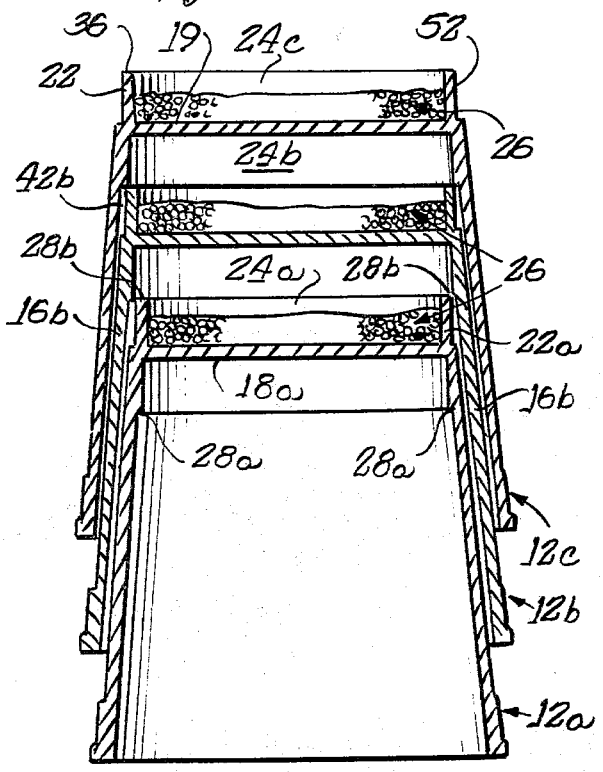
FIG. 2 is a side view of a partially completed package of nested cups embodying certain features of the present invention shown in section; and, FIG. 3 is a perspective view of the finished package of the nested cups of FIG. 2.

After dehydrated material 26 is placed into the enclosure **24*a* of an inverted cup 12a as shown in FIG. 2, a second inverted cup 12*b* is placed over the cup 12a for sealing engagement with the base wall 22*a* to complete the sealed enclosure 25 between adjacent cups. Herein, in this illustrated embodiment, each side wall 16 has an inwardly projecting wall or shoulder 28, as shown in FIG. 1, for sealing engagement with the base wall 22 of an adjacent nested cup. Thus, referring back to FIG. 2, the sealed enclosure 25*a* is defined by the bottom walls 18*a* and 18*b* of the cup 12*a* and the adjacent cup 12*b*, respectively, the base wall 22*a* of the cup 12*a* and that portion of the side wall 16*b* of the adjacent cup 12*b* between the shoulders 28*b* and the bottom wall 18*b* of the cup 12*b*. When the package is not inverted, as shown in FIG. 3, the shoulders 28*b* of the adjacent cup 12b support the base wall 22*a* of the previous cup 12 above the bottom wall 18*b* of the adjacent cup 12*b* to provide the sealed enclosure 25*a***.

In a similar manner, a third cup **12*c* which is stacked over the cup 12*b*, has a sealing engagement with the base wall 22*b* to complete and seal the enclosure 25*b* to contain the dehydrated material 26. The food receiving receptacles 24 are usually filled in a conveyor line with the cups following each other in seriatim fashion to a stacking station at which, the cups having already been filled, are then stacked. A simple lid 50 is then placed over the uppermost cap seat of the top cup of the inverted stack. Finally, a plastic cover is placed over the stack of inverted and nested cups and shrunk to provide an endwise pressure to maintain the sealed enclosures for the cups and food product therein, as shown in FIG. 3**.

The side wall 16 of each cup 12 is generally conical and has an outside surface 30 which tapers outwardly with a uniform slope of about 5 ½° from the bottom wall 18 to a lip 32 of thickened cross section on which lid (not shown) can be fitted. The side wall 16 further has an inside surface 34 which is generally at the same angle as the outside surface 30 from the shoulder 28 to the lip 32 giving the side wall 16 a uniform cross sectional thickness of about 0.07 inches for most of its height. By way of example, one size of cup of 5½, 6½ ounce capacity may have an outside diameter of about 2.895 inches and an inside diameter of about 2.670 inches. This same cup has liquid receiving depth of 2.698 inches from the bottom wall 18 to the lip 32 giving a practical capacity of about 5½ ounces (or 6½ ounces if filled to the brim). The sealing shoulder 28 is about 0.0801 inch in width between an outer diameter of about 2.2174 inch and an inner diameter of about 2.21571 inch when the shoulder is located about 0.418 inch above the bottom wall. The shoulder 28 is a generally flat, radially extending ridge on the interior of the wall 16. For this same size, the rim 36 of the base wall will have an outer diameter of about 2.2136 inch which is intermediate the diameters of 2.1571 and 2.2174 inches defining the shoulder 28. Thus, the rim 36 of one nested cup should abut the shoulder 28 of an adjacent nested cup.

Although the illustrated embodiment is shown provided with a shoulder 28, it should be noted that it is contemplated that the base wall 22 may make other types of sealing engagements with an adjacent cup. For example, the shoulder 28 may be removed and the rim 36 of the base wall 22 may be of a diameter allowing it to engage directly with the bottom wall 18 of an adjacent cup so that the depth of the enclosure 24 would be defined only by the depth of the base wall 22. As a further alternative, the annular outer surface 38 of the base wall may be in direct sealing and tight engagement with the inner frusto conical wall 34 of an adjacent cup, particularly if such a cup is formed without a shoulder 28.

For the cup described above, the base wall 22 extends approximately 0.332 inches from the bottom wall 18 and is thicker in cross-sectional area than the side wall 16 for added structural strength. The base wall 22 is further provided with a flat bottom edge or rim 36 to improve the sealing capabilities of the base wall. Cups constructed from paper and thin plastic often have a rounded bottom edge on the cap seat thus providing only a line contact between the cap seat and an adjacent cup allowing dehydrated material to sift out from the enclosure. The flat bottom edge 36 increases the contact area between the base wall 22 and the shoulder 28 (or bottom wall 18 in an alternative embodiment) of the adjacent cup.

The base wall has an outer annular surface 38 which extends substantially vertically from the bottom wall 18 and has an inner surface 40 which preferably tapers at a uniform slope of about 5½° from the bottom wall 18. For the size of cup described and base wall 22 has an overall outside diameter of 2.2074 inches. As best seen in FIG. 2, since the diameter of the cup side wall at the shoulder 28 is larger than the diameter of the base wall rim 36, a space 42 is provided between the base wall of a cup and the side wall of an adjacent cup when the cups are nested or stacked. Thus, for example, a space **42*b* is provided between base wall 22*b* of cup 12*b* and side wall 22*c* of adjacent cup 12*c*. This spacing allows the base wall of each cup to securely engage the shoulder 28 of an adjacent cup without the frusto conical sidewalls being tightly wedged together. Such a mating of rims 36 and shoulders 28 ensures a tight seal, which is, of course, important to prevent premature spoilage of the food as well as to prevent food from sifting out and providing an unsightly soiling of the packaging material forming the cover 14**.

In summary, a package of nested cups utilizing the present invention is provided with a sealed enclosure capable of containing large bulky foods. Indeed, depending upon the dimensions selected for the base wall (and the shoulder, if utilized) as much as ⅛ of the total height of each cup within a nested stack can be utilized as enclosure space. In such a case, an enclosure could hold at least 19cc of food product.

Furthermore, cups, constructed as taught herein, are ideal for hot liquids such as coffee and hot chocolate and do not impart a distasteful paper taste. Moreover, the foamed polystyrene material provides the capability for numerous structural design features as described herein which further facilitate a sealing engagement between adjacent cups.

Although the description above has been made in terms of a preferred embodiment, it is not intended to disclaim obvious variations in construction or materials which can be made without departing from this invention.

Various features of the invention are set forth in the following claims.

What is claimed is:

1. A package of nested disposable cups with deliquescent or hygroscopic material for use in dispensing beverages or food products comprising:

a plurality of disposable cups telescoped together into a nested stack, each of said cups being one piece and formed of foamed polystyrene plastic material and having a substantially frusto-conical, thick side wall with an interior foamed polystyrene surface for engaging said material, each of said cups having a rim at the upper end of said side wall defining an opening into said cup, each of said cups further having a planar bottom wall integrally joined to said side wall to define thereabove a food storage and liquid mixing chamber and a base wall integrally joined to said bottom wall and extending downwardly approximately 0.3 to 0.5 inch from said bottom wall to define therewith a cap seat and a bottom downwardly opening enclosure for being filled with the material while inverted, the outer side of said frusto-conical side wall extending in a continuous taper to said planar bottom wall; each of said base walls having an outer side offset radially inwardly of its side wall at a location beneath said planar bottom wall; said base walls having a cross-sectional thickness greater than the cross-sectional thickness of its side wall;

said side walls of said adjacent nested cups having a shoulder means integrally formed on the interior of the adjacent nested cup side wall for supporting said base wall above the bottom wall of the adjacent nested cup to provide a sealed enclosure bounded by said bottom walls, said base wall and the portions of side wall of the adjacent nested cup between said bottom walls; said shoulder means being spaced above said bottom wall by a distance not substantially greater than the depth of said downwardly opening enclosure;

a measured quantity of product in said sealed enclosure; and means for applying an endwise pressure to said stack to maintain said sealed enclosure.

2. A package of nested cups in accordance with claim 1 wherein said shoulder means is a generally flat, radially extending ridge and said base wall has a flat bottom edge for an abutting sealing engagement with said ridge.

3. A package of nested cups in accordance with claim 1 wherein said base wall has a flat bottom edge for an abutting sealing engagement with said adjacent nested cup.

4. A package of nested cups in accordance with claim 1 wherein said cups are thick walled cups each having a side wall approximtely 0.7 inches thick.

5. a package of nested cups in accordance with claim 1 wherein said enclosure is at least about ⅛ of the total height of said cup.

6. A package of nested cups in accordance with claim 1 wherein said enclosure will hold at least 19cc of said product.

* * * * *